US010043603B2

(12) United States Patent
Robben et al.

(10) Patent No.: US 10,043,603 B2
(45) Date of Patent: Aug. 7, 2018

(54) SURGE ARRESTER

(71) Applicant: SIEMENS AKTIENGESELLSCHAFT, Munich (DE)

(72) Inventors: Bastian Robben, Berlin (DE); Henrik Roggow, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 15/486,483

(22) Filed: Apr. 13, 2017

(65) Prior Publication Data

US 2017/0301438 A1 Oct. 19, 2017

(30) Foreign Application Priority Data

Apr. 13, 2016 (DE) ..... 10 2016 206 176

(51) Int. Cl.

| | |
|---|---|
| ***H01C 7/10*** | (2006.01) |
| ***H01C 7/12*** | (2006.01) |
| ***H01C 1/02*** | (2006.01) |
| ***H01C 1/16*** | (2006.01) |

(52) U.S. Cl.

CPC ..... *H01C 7/12* (2013.01); *H01C 1/02* (2013.01); *H01C 1/16* (2013.01)

(58) Field of Classification Search

CPC ..... H01C 7/12; H01C 1/02; H01C 1/16
USPC ..... 338/21, 13
See application file for complete search history.

(56) References Cited

U.S. PATENT DOCUMENTS

| | | | | |
|---|---|---|---|---|
| 5,936,826 | A * | 8/1999 | Schmidt | H01C 7/12 361/117 |
| 6,777,614 | B1 * | 8/2004 | Suenwoldt | H01C 7/12 174/50 |
| 8,009,402 | B2 * | 8/2011 | Klaube | H01C 7/123 361/117 |
| 8,064,181 | B2 * | 11/2011 | Klaube | H01C 7/12 361/117 |
| 8,446,703 | B2 * | 5/2013 | Klaube | H01C 7/12 361/117 |
| 8,982,526 | B2 * | 3/2015 | Anjiki | H01C 7/12 361/126 |
| 2017/0084367 | A1 | 3/2017 | Bockarev et al. | |

FOREIGN PATENT DOCUMENTS

| | | | |
|---|---|---|---|
| DE | 102005024206 | B4 | 3/2007 |
| DE | 102008048840 | A1 | 4/2009 |

(Continued)

OTHER PUBLICATIONS

DE102008048840, Klaube, Apr. 2009, machine translation.*
"High-voltage surge arresters—Product guide", Siemens AG 2012, siemens.com/energy/arrester.

*Primary Examiner* — Kyung Lee
(74) *Attorney, Agent, or Firm* — Laurence Greenberg; Werner Stemer; Ralph Locher

(57) ABSTRACT

A surge arrester has a resistance column which is pressed together by one or more clamping devices. The clamping devices are each fixed at both ends of the resistance column to an end fitting by way of a fixing device. An electrically insulating housing encloses the fixing device. Each end fitting has a first contour, on which the fixing devices are arranged and which is enclosed by the housing. The end fitting also has a second contour with a smaller diameter than the first contour.

9 Claims, 2 Drawing Sheets

(56) References Cited

FOREIGN PATENT DOCUMENTS

| | | | |
|---|---|---|---|
| EP | 1206820 | B1 | 1/2003 |
| EP | 3144942 | A1 | 3/2007 |
| EP | 1977434 | B1 | 7/2009 |
| JP | 2004071972 | A | 3/2004 |
| WO | 2009044462 | A1 | 4/2009 |

* cited by examiner

SURGE ARRESTER

CROSS-REFERENCE TO RELATED APPLICATION

This application claims the priority, under 35 U.S.C. § 119, of German patent application DE 10 2016 206 176.3, filed Apr. 13, 2016; the prior application is herewith incorporated by reference in its entirety.

BACKGROUND OF THE INVENTION

Field of the Invention

The invention relates to a surge arrester having a resistance column which is pressed together by at least one clamping device. Each clamping device is fixed at both ends of the resistance column to an end fitting by a fixing device. An electrically insulating housing encloses the fixing device (13). Each end fitting has a first contour on which the fixing device is arranged.

Surge arresters are used to dissipate impermissible voltages, for example as a result of a lightning strike into an open cable to ground and, in this way, to protect other devices such as transformers, for example. For this purpose, surge arresters have metal oxide elements stacked to form columns which are barely electrically conductive below a designed threshold voltage but above the threshold voltage exhibit good electric conductivity. Such surge arresters are known from the product brochure "High-voltage surge arresters—product guide", Siemens AG 2012, order number E50001-G630-A249-X-4A00.

Commonly assigned U.S. Pat. No. 6,777,614 B1 and its counterpart European patent EP1 206 820 B1 disclose tensioning a column of resistance elements by means of circular rods made of fiber-reinforced epoxy resin in order to achieve a high flexural rigidity. The rods surround the column of resistance elements in the manner of a cage, the ends of the rods each being fixed in an end fitting. The fixing in the end fitting is carried out by means of conical clamping sleeves. The prior art disclosure is incorporated herein by reference.

As a rule, an electrically insulating housing for surge arresters is produced by over molding the resistance column with silicone. Here, the ends of the rods in the end fitting also have to be closed with silicone in order that, following the potting of an insulating housing, no moisture can penetrate into the housing from outside.

In this connection, U.S. Pat. No. 8,009,402 B2 and its counterpart European patent EP 1 977 434 B1 propose to provide a circular groove in the end fitting, in which both the fixing device for the rods and also additional holes are respectively arranged. The prior art disclosure is incorporated herein by reference. If, then, a cover is placed on the groove and silicone is pressed into a casting mold placed with a form fit on the end fitting, then the silicone presses through the additional holes in the end fitting into the groove and there, on the side of the end fitting that faces away from the resistors, closes the fixing device of the rods securely with silicone.

SUMMARY OF THE INVENTION

It is accordingly an object of the invention to provide a surge arrester which overcomes the above-mentioned and other disadvantages of the heretofore-known devices and methods of this general type and which provides for a surge arrester that can be potted comparatively simply with silicone.

With the foregoing and other objects in view there is provided, in accordance with the invention, a surge arrester, comprising:

a resistance column that is pressed together by at least one clamping device;

an end fitting at each end of said resistance column, said end fitting having a first contour with a given diameter and a second contour with a diameter that is smaller than the given diameter of said first contour;

a fixing device fixing said at least one clamping device at each end of said resistance column to said end fitting, said fixing device being disposed on said first contour;

an electrically insulating housing enclosing said fixing device.

It is a substantial advantage of the present invention that the end fitting can be produced relatively simply and, at the same time, prevents the penetration of moisture into the interior of the surge arrester via the fixing of the clamping devices or rods. It is important here that the second contour does not cover the first contour but leaves the openings for the fixing device and the clamping devices free. In this way, in an appropriate mold, the silicone is able to flow on the outside around the first contour and to form a housing which completely encloses the clamping devices and the fixing device in the openings or flange apertures. The silicone then ends in a sealing face of the second contour. This design of the surge arrester dispenses with the comparatively complicated arrangement of additional holes in order to arrange for silicone as it were to flow from inside through the second contour and the flange on the side facing away from the resistors and to be distributed there in a groove for the purpose of sealing. Problems with silicone flowing through the openings and with uniform distribution on the flange are avoided.

The surge arrester according to the invention is therefore simpler and more economical to produce than prior art surge arresters.

In accordance with an added feature of the invention, the first contour has at least one opening, in which the at least one clamping devices is fixed by the fixing device. In the simplest case, for example, the opening is formed as a pre-drilled flange aperture.

In a further preferred embodiment of the surge arrester according to the invention, the fixing device has a substantially conically shaped conical segment which is fixed to the clamping devices, wherein the opening is shaped so as to correspond to the conical segment. This conical formation is advantageous, since a secure and stable clamping fit of the fixing device in the respective end fitting is achieved.

In accordance with a preferred embodiment of the invention, the second contour is in each case arranged on the side of the first contour that faces away from the resistance column. It is particularly preferred if the first contour and the second contour are formed substantially in the shape of a disk. The second contour, as a disk with a smaller diameter than the first contour, can be arranged in the center of the first contour in such a way that an annular step is formed on the first contour. The openings can be arranged on this annular step.

In a further preferred embodiment of the surge arrester according to the invention, the second contour has a sealing face, on which the outer housing rests with a form fit, so that the outer housing completely encloses the first contour. The sealing face is preferably the outer of the second contour formed in the manner of a disk, so that during production the silicone can flow from outside around the first contour via the openings and can finally finish at the second contour.

In a further preferred embodiment of the surge arrester according to the invention, the second contour in each case has at least one connecting device for mechanical and/or electrical connection of the surge arrester. For example, an internal thread for a screw connection can be provided, wherein a screw that is screwed in can firstly form a mechanical connection and secondly an electrically conductive connection to the resistors. The connecting device can extend both through the second and the first contour, in order for example to achieve a conventional thread length of 32 mm depth.

In a further preferred embodiment of the surge arrester according to the invention, the outer housing consists at least partly of silicone. This is an advantage, since silicone is a usual and long-term tested material for electrical insulation.

In a further preferred embodiment of the surge arrester according to the invention, the resistance column has a plurality of metal oxide resistors, forming dissipation elements, arranged one above another.

In a further preferred embodiment of the surge arrester according to the invention, at least four clamping devices are provided. This is an advantage since, in this way, a mechanically stable cage can be formed, in which the resistance elements are pressed together along a longitudinal axis. At a minimum, as a rule three clamping devices are sufficient in order to form a structure that is secured against the resistors slipping out (with an angle of about 120° between the rods), but designs with up to 10 or more clamping devices have proven worthwhile.

In a further preferred embodiment of the surge arrester according to the invention, the clamping device comprises an electrically non-conductive plastic.

In accordance with a concomitant feature of the invention, each clamping device has a glass fiber reinforced rod.

Other features which are considered as characteristic for the invention are set forth in the appended claims.

Although the invention is illustrated and described herein as embodied in a surge arrester, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
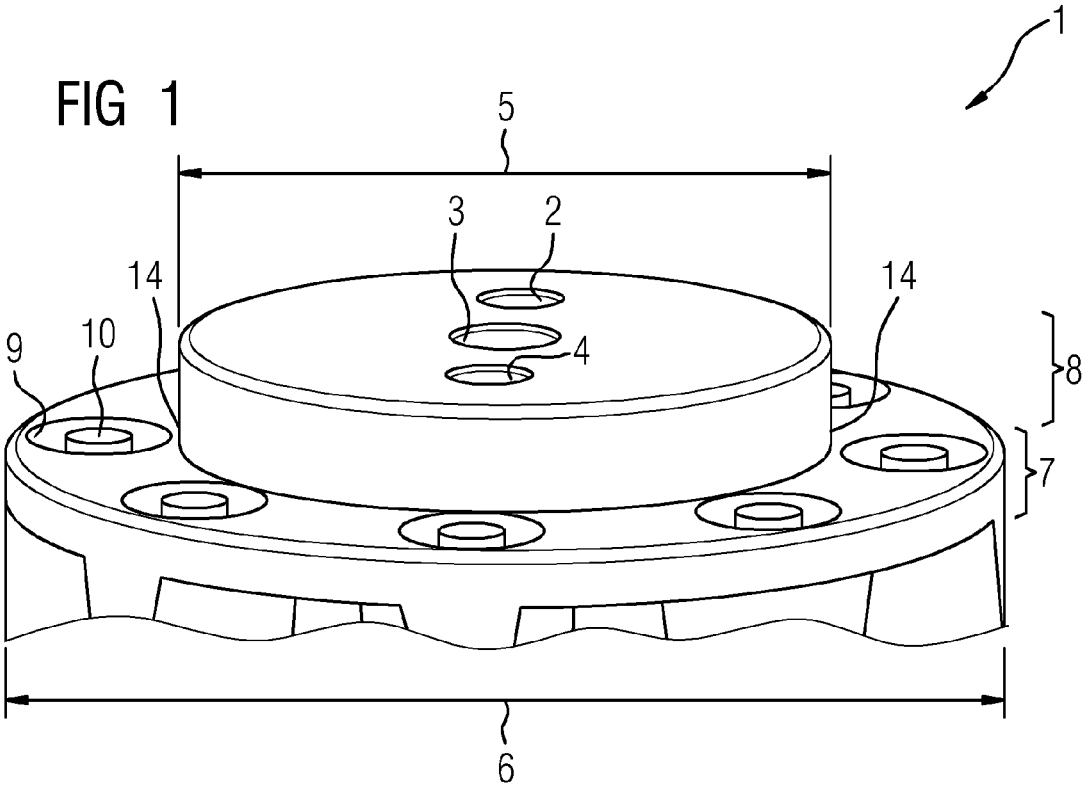
FIG. 1 shows a perspective view of an embodiment of an end fitting of a surge arrester according to the invention.

Referring now to the figures of the drawing in detail and first, particularly, to FIG. 1 thereof, there is shown an end fitting 7, 8 of a surge arrester 1 according to the invention. The end fitting has a first contour 7 and a second contour 8. The two contours 7, 8 are each formed as a disk, which are stacked one above another on a common center. The first contour 7 has a diameter 6, and the second contour 8 has a diameter 5. In this way, the second contour 8 forms an annular step on the first contour 7. The two contours 7, 8 can be produced from one work piece or they may be assembled from two work pieces.

Located on the step are flange apertures or openings 9, in which the ends of clamping devices 10 can be seen. The clamping devices 10 here are glass fiber-reinforced rods, which are distributed angularly symmetrically (i.e. with the same angular spacing from one another) on the step running around the second contour.

The second contour 8 forms with its cylindrical outer a sealing face 14, on which the silicone ends as the outer housing is cast. The second contour is formed with openings 2, 3, 4. The opening 3 has a connecting device 3 for a mechanical and/or electrical connection of the surge arrester. The openings 2, 3 can be formed, for example, as further connecting openings or as attachment points for mounting tools.

Figure 2:
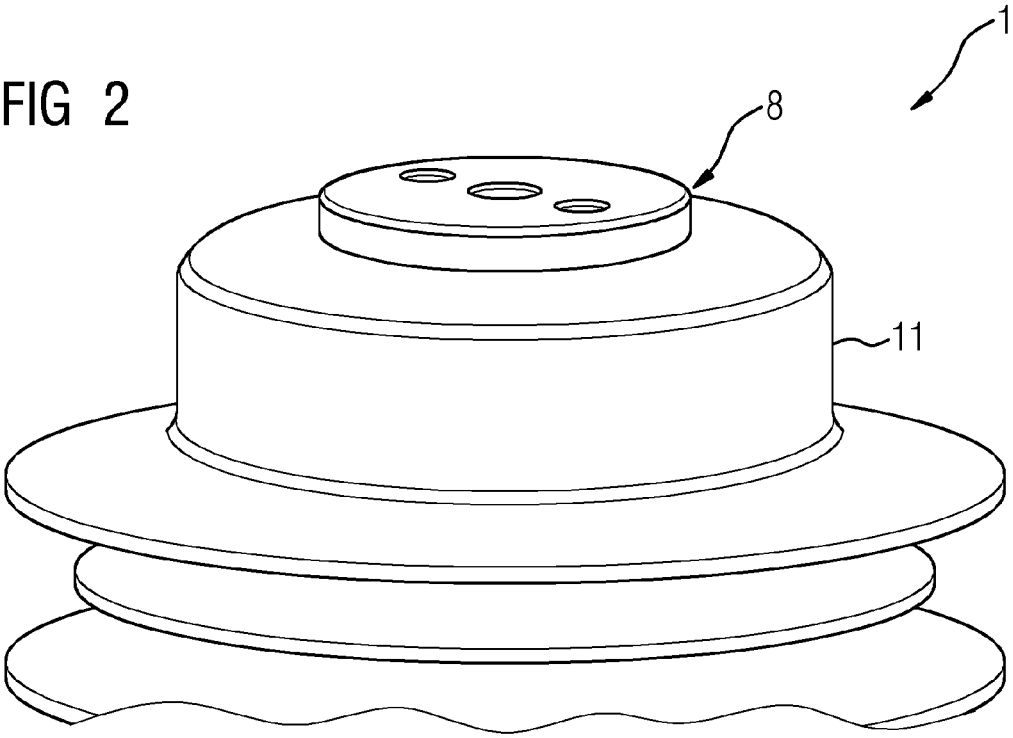
FIG. 2 is a perspective view showing the end fitting from FIG. 1 with an outer housing made of silicone.

FIG. 2 shows the surge arrester 1 following the casting of an outer housing made of silicone. Silicone flows completely around the first contour, so that the openings for the clamping devices are also protected reliably against the penetration of moisture. Only the second contour 8 projects by about half its height out of the silicone sheath.

Figure 3:
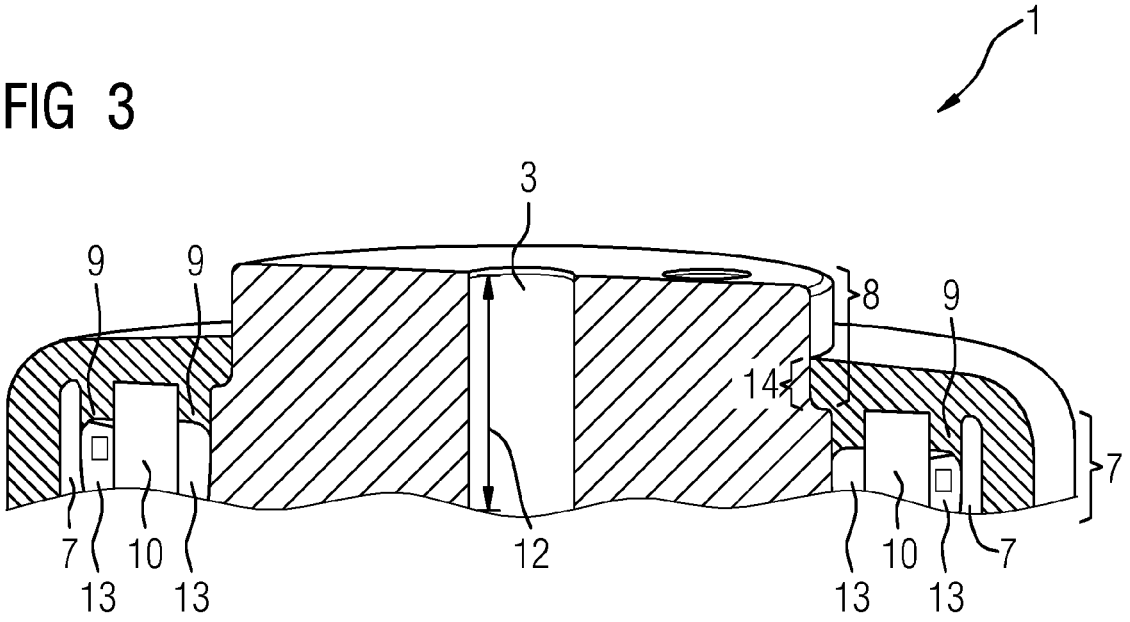
FIG. 3 shows a cross section through the end fitting with the outer housing according to FIG. 2.

FIG. 3 shows a cross section through the end fitting of the surge arrester 1. The connecting device 3 has a depth 12 and is provided with an internal thread. The cross section shows two openings 9 in the first contour 7, in each of which a fixing device 13 fixes the respective clamping device 10. The housing of silicone 11 covers the first contour 7 completely and ends on the sealing face 14 of the second contour 8.

The invention claimed is:

1. A surge arrester, comprising:

a resistance column that is pressed together by at least one clamping device;

an end fitting at each end of said resistance column, said end fitting having a first contour with a given diameter and a second contour with a diameter that is smaller than the given diameter of said first contour;

a fixing device fixing said at least one clamping device at each end of said resistance column to said end fitting, said fixing device being disposed on said first contour, and fixing said at least one clamping device is an opening formed in said first contour;

said fixing device having a substantially conically shaped conical segment affixed to said clamping device, and said opening in said first contour being shaped so as to correspond to said conical segment;

said second contour having a cylindrical outer surface and forming an annular step on said first contour;

an electrically insulating outer housing formed of silicone enclosing said fixing device, said cylindrical outer surface of said second contour forming a sealing face, on which said silicone ends as said outer housing is cast.

2. The surge arrester according to claim 1, wherein said second contour is in each case arranged on a side of said first contour that faces away from said resistance column.

3. The surge arrester according to claim 1, wherein said second contour has a sealing face, on which said outer housing rests with a form fit, so that the outer housing completely encloses said first contour.

4. The surge arrester according to claim 1, wherein said second contour in each case has at least one connecting device for mechanical and/or electrical connection of the surge arrester.

5. The surge arrester according to claim 1, wherein said outer housing consists at least partly of silicone.

6. The surge arrester according to claim 1, wherein said resistance column includes a plurality of metal oxide resistors arranged one above another.

7. The surge arrester according to claim 1, wherein said at least one clamping device is one of at least four clamping devices.

8. The surge arrester according to claim 1, wherein said at least one clamping device comprises an electrically non-conductive plastic.

9. The surge arrester according to claim 1, wherein each clamping device comprises a glass fiber reinforced rod.

* * * * *